US007872229B2

(12) United States Patent
Park et al.

(10) Patent No.: US 7,872,229 B2
(45) Date of Patent: Jan. 18, 2011

(54) THREE-DIMENSIONAL RF ION TRAPS WITH HIGH ION CAPTURE EFFICIENCY

(75) Inventors: Melvin A. Park, Billerica, MA (US); Michael Schubert, Bremen (DE); Jochen Franzen, Bremen (DE)

(73) Assignee: Bruker Daltonik, GmbH, Bremen (DE)

( * ) Notice: Subject to any disclaimer, the term of this patent is extended or adjusted under 35 U.S.C. 154(b) by 58 days.

(21) Appl. No.: 12/172,605

(22) Filed: Jul. 14, 2008

(65) Prior Publication Data

US 2009/0032700 A1 Feb. 5, 2009

(30) Foreign Application Priority Data

Jul. 23, 2007 (DE) ..... 10 2007 034 232

(51) Int. Cl.
*H01J 49/42* (2006.01)

(52) U.S. Cl. ..... 250/292; 250/290; 250/396 R

(58) Field of Classification Search ..... 250/292, 250/290, 396 R, 281, 282
See application file for complete search history.

(56) References Cited

U.S. PATENT DOCUMENTS

| | | | | |
|---|---|---|---|---|
| 4,755,670 | A * | 7/1988 | Syka et al. | 250/292 |
| 5,468,958 | A | 11/1995 | Franzen et al. | |
| 5,811,800 | A | 9/1998 | Franzen et al. | |
| 6,483,109 | B1 * | 11/2002 | Reinhold et al. | 250/292 |
| 6,911,651 | B2 * | 6/2005 | Senko et al. | 250/292 |
| 6,989,534 | B2 | 1/2006 | Schubert et al. | |
| 7,019,289 | B2 * | 3/2006 | Wang | 250/290 |
| 2003/0173524 | A1 | 9/2003 | Syka | |
| 2004/0149903 | A1 | 8/2004 | Wang | |
| 2005/0199804 | A1 | 9/2005 | Hunt et al. | |

FOREIGN PATENT DOCUMENTS

| | | | |
|---|---|---|---|
| DE | 102005049549 | A1 | 4/2007 |
| DE | 102005004324 | B4 | 4/2008 |
| GB | 2 280 305 | A | 1/1995 |
| GB | 2 438 698 | A | 12/2007 |
| GB | 2 447 325 | A | 9/2008 |
| WO | WO 02/091427 | A2 | 11/2002 |
| WO | WO 2007/027764 | A2 | 3/2007 |

* cited by examiner

*Primary Examiner*—Kiet T Nguyen
(74) *Attorney, Agent, or Firm*—Law Offices of Paul E. Kudirka

(57) ABSTRACT

In a three-dimensional Paul RF ion trap at least one of the ring electrode and end cap electrodes is structured to produce a high capture efficiency for analyte ions introduced into the trap. The electrode structuring may be produced by an electrode surface profile having edges or protrusions, resulting in a scattering reflection of the introduced ions. Alternatively, at least one electrode may be formed by physically separate electrode components. In one embodiment, the trap can be switched between operating as a linear ion trap with good capture efficiency and operating as a three-dimensional ion trap with good ion reaction conditions.

6 Claims, 3 Drawing Sheets

THREE-DIMENSIONAL RF ION TRAPS WITH HIGH ION CAPTURE EFFICIENCY

BACKGROUND

The invention relates to three-dimensional Paul RF ion traps with high efficiency for the collection of analyte ions provided for subsequent reactions, especially for monomolecular reactions or reactions with reactants, preferably for reactions between positive analyte ions and negative reactant ions.

As is well known, three-dimensional Paul RF ion traps consist of at least one ring and two end cap electrodes, and operate with an RF voltage between ring and end cap electrodes. In most cases, only a single phase of this voltage is used, applied to the ring electrode. If the electrodes are designed as ideal hyperboloids of revolution, the strength of the RF field increases linearly from the center outwards in all spatial directions, hence the term "three-dimensional". An inhomogeneous RF field is therefore generated in the interior. Any inhomogeneous electric RF field acts on ions in a way which can be described by a so-called "pseudopotential". The pseudopotential increases quadratically in a three-dimensional RF ion trap in all spatial directions and has a minimum in the center of the ion trap; it drives the ions of both polarities from all spatial directions into the center of the ion trap and thus makes them oscillate through or around the center. If the electrodes are of the ideal shape, the pseudopotential is harmonic; it makes the ions oscillate harmonically. Harmonic oscillation is characterized by the fact that its oscillation frequency always remains the same, regardless of the oscillation amplitude.

If the ion trap is filled with a collision or damping gas at a pressure between 0.001 and 1 Pascal, the oscillations of ions introduced from outside through apertures in the end cap electrodes are damped so that the ions finally collect in a small cloud in the center of the ion trap. The size of the cloud is determined by the centripetal force of the pseudopotential field in the ion trap and the centrifugal force caused by the Coulomb repulsion between the ions. Since the pseudopotential acts on positive and negative ions in the same way, ions of both polarities can be captured. In particular, it is also possible to capture both ion species simultaneously or consecutively so that they react with each other in the damped ion cloud.

Such reactions between positive and negative ions are analytically of great interest. It is thus possible to use specific types of negative reactant ions to cleave multiply positively charged peptide or protein ions by a transfer of an electron ("ETD"=electron transfer dissociation), as described, for example, in the patent application publications DE 10 2005 004 342 A1 (R. Hartmer and A. Brekenfeld) and US 2005/0199804 A1 (D. F. Hunt et al.). The multiply charged positive peptide or protein ions which are analyzed with this method form the "analyte ions" introduced above. The electron-induced dissociation of the analyte ions is complementary to the collision-induced dissociation (CID) because, firstly, it cleaves at different points of the amino acid chain and, secondly, it does not split off the side chains of the post-translational modifications (PTM) during fragmentation, as happens with collision-induced dissociation.

On the other hand, reactions between multiply positively charged analyte ions and certain types of negatively charged ions can also be used to reduce the number of charges on each of the positive analyte ions ("PTR"=proton transfer reactions, also called "charge stripping"). Charge stripping makes it possible to convert very heavy, highly charged analyte ions into ions whose isotope patterns can be resolved in the mass spectrometer. The analyte ions can be, for instance, converted right down to singly-charged ions in order to reduce the complexity of mixtures of many heavy, highly charged analyte ions.

In three-dimensional ion traps, ions can also react with neutral particles if these are introduced into the ion trap. This makes it possible to generate derivatizations, for example, or to label by using heavy isotopes of an element, such as by replacing hydrogen with deuterium. Also, of particular significance is electron transfer by highly excited neutral particles, which leads to similar fragmentations as electron transfer by negative ions. Such highly excited neutral particles can be generated in a so-called "FAB source" (FAB=fast atom bombardment), which generates a well-directed, fine beam of highly excited atoms, for example highly excited helium atoms. This beam can be directed very effectively through a hole in the ring electrode at the small cloud of analyte ions which forms in a three-dimensional ion trap. The elongated thread-like cloud of analyte ions which builds up in a linear ion trap does not lend itself easily to the use of a conventional FAB source for the fragmentation unless the beam of neutral particles can be directed along the axis into this cloud.

So-called "unimolecular reactions" without reactant substance molecules or ions are also possible, as occur with bombardment with sufficient quantities of infrared photons (IRMPD=infrared multiple photon dissociation), for example. This type of bombardment can also be carried out particularly well in three-dimensional ion traps because of the formation of a small spherical cloud.

Three-dimensional RF ion traps themselves can also be used as mass analyzers for the product ions created. They then have to very precisely maintain a certain shape of electrode to enable a precisely resonant excitation, especially for a good mass-resolved ejection of the ions for measurement in a mass spectrum. The precise form is necessary to ensure that, by means of a good harmonic pseudopotential field, the excitation frequencies of the oscillating ions during resonant excitation are kept constant and independent of the oscillation amplitude. The electrodes must be designed so as to generate a very well-formed quadrupole field in the interior. In some quadrupole mass spectrometers, however, small amounts of higher multipole fields are also very precisely superimposed on the quadrupole field. Such willfully generating deviations from the pure quadrupole field can, on the one hand, introduce non-linear, very strong and sharp resonance conditions and, on the other hand, keep the ions in resonance while a mass scan is in progress.

However, this precise form, which consists primarily of smooth-surfaced ring and end cap electrodes in the precise shape of a hyperboloid of revolution, means that the capture of the ions introduced from the outside is limited to some 5% to 10% of the analyte or reactant ions which are fed in. This limitation is the biggest disadvantage of the high-precision hyperboloid of revolution RF ion traps, which have been used exclusively until now in commercially produced ion trap mass spectrometers. Frequently, the analyte ions are only present in very small quantities in a sample. Consequently, the detection sensitivity of the ion trap mass spectrometers, which is very important in bioanalysis, is reduced.

The success rate for ion capture in so-called "linear multipole ion traps", which comprise four or more pole rods, is much higher. In a linear ion trap, the ions are driven radially toward the axis by the pseudopotential; they gather in an elongated ion cloud along the axis. The linear ion trap is also often called "two-dimensional" because the pseudopotential changes only in two spatial directions and remains constant in the third spatial direction, the axis of the linear ion trap. The ions are introduced axially with low kinetic energy and can easily be captured in the elongated ion trap by a collision gas if the mean free path in the collision gas is kept sufficiently short by a suitable pressure. If the ions are introduced precisely centrally in the axial direction, they do not come up against a decelerating RF field in any phase; slightly outside the axis there are weak fields which have the effect of focusing the ions toward the axis. Ions can therefore be injected with low kinetic energy and captured with a high yield.

Linear ion traps must, however, be closed off at both ends by repulsive potentials in order to prevent the ions from simply escaping. DC potential barriers at apertured diaphragms are generally used for this, but it is then only possible to store ions of a single polarity, i.e. either positive ions or negative ions. It is also possible, in principle, to generate pseudopotential barriers at both ends, but this is much more difficult than producing the boundary with DC potential barriers, and is therefore hardly ever used in practice. Unless special mechanical and electronic measures have been taken, linear ion traps therefore have limited use for reactions between positive and negative ions. Moreover, the cooled ions are not located in an almost spherical cloud, but instead form an elongated cloud which stretches along the axis of the linear ion trap.

If reactions between positive and negative ions are to be brought about in such linear ion traps, the clouds of positive analyte ions and negative reactant ions are sometimes collected in separate sections of a segmented linear ion trap, called "pre filter" and "post filter", and are then fed to a thorough mixing in the center part of the linear ion trap by a special configuration of the axis potentials. This method is explained in great detail in the publication of patent application US 2005/0199804 A1 (D. F. Hunt et al.), already cited above.

This method has disadvantages, however. If a fragmentation by electron transfer is carried out, for example, the heads of the two ion clouds penetrate each other initially, and their ions react with each other. With further penetration, the positive fragment ions formed in the cloud heads can react further in an undesirable way with subsequent negative reactant ions, and some of them can be completely neutralized before the analyte ions in the tail of the cloud have even come into contact with the first reactant ions. This disadvantage does not occur in three-dimensional RF ion traps because the reactions occur in a very homogeneous way.

SUMMARY

The invention achieves a high success rate for the capture of analyte ions, i.e. a high capture efficiency, by structuring at least one of the electrodes of a three-dimensional ion trap; this high capture rate is, however, only possible if the three-dimensional RF ion trap is no longer used as a mass analyzer. Such a three-dimensional ion trap can be used as a reactor for the analyte ions, for example. Since reactant ions (or other reacting agents) can be produced in excess, it is not essential that the method provides a high capture efficiency for them.

Since the pseudopotential well no longer needs to be strictly harmonic for good resonant ion ejection, the form of the ion trap used can be very different from conventional commercial ones, which are manufactured solely in a hyperbolic form. And since the oscillations for ion ejection no longer have to continue over several oscillation cycles with low collision rates, the pressure of the collision gas can be increased considerably, which is also favorable for ion capture.

The structuring of the electrodes can generate a profiled surface of one or more electrodes, with a pattern of ridges, edges or protrusions, so as to achieve a diffuse reflection of the ions, for example; or it can go as far as a complete division of the electrodes into electrode components, and it is even possible to apply different voltages, for example different phases of an RF voltage, to the components of the divided electrode.

If the surfaces of the electrodes, particularly those of the end cap electrodes, may have striated or ridged profiles, for example, it is possible to achieve a diffuse, scattering reflection of the ions to improve the ion capture.

By using ring electrodes which are divided and shaped as straight or curved pole rods, for example, it is even possible to switch voltages so that the system can operate for part of the time as a multipole rod system, with familiar good ion capture, and for part of the time as a three-dimensional RF ion trap for homogeneous reactions with favorable access to the ion cloud.

Dividing the end cap electrodes and using two DC or RF voltages can also produce a laterally deflecting reflection.

The three-dimensional RF ion traps according to the invention can be operated in pass-through mode, i.e. with different apertures for injection and ejection, or in reflection mode of operation, where injection and ejection occur through the same aperture.

BRIEF DESCRIPTION OF THE DRAWINGS

For the hexapole ion trap shown in FIG. 5.

DETAILED DESCRIPTION

Figure 1:
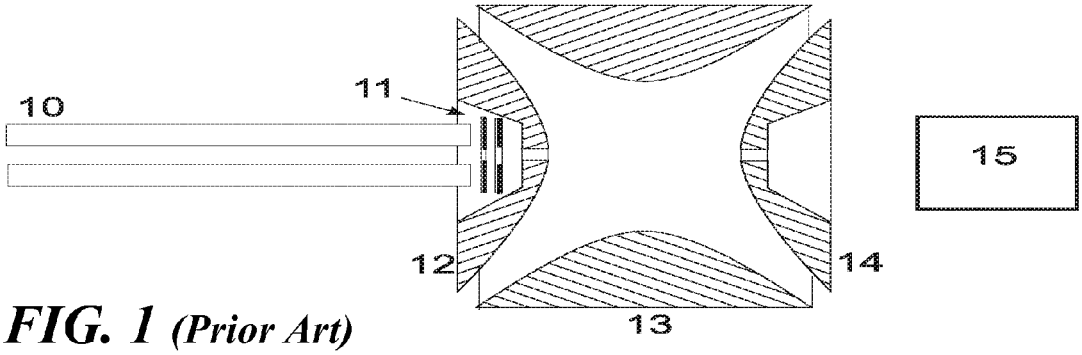
FIG. 1 (Prior Art)
FIG. 1 shows a three-dimensional RF ion trap in an embodiment according to the prior art, where the interior shape of the ring electrode (13) and the end cap electrodes (12 and 14) is a hyperboloid of revolution with smooth surfaces. This embodiment permits a very precise resonant excitation of the ions, and its good mass-selective ion ejection to the detector (15) makes it eminently suitable for use as a mass analyzer. The ions are usually fed in by a multipole ion guide, for example a quadrupole ion guide (10), and a lens (11), which conveys the ions into the three-dimensional ion trap.

While the invention has been shown and described with reference to a number of embodiments thereof, it will be recognized by those skilled in the art that various changes in form and detail may be made herein without departing from the spirit and scope of the invention as defined by the appended claims.

The problem of ion capture in conventionally shaped three-dimensional RF ion traps is described in detail in the patent specification U.S. Pat. No. 6,989,534 B2 (J. Franzen and M. Schubert). Of all the ions injected through an end cap electrode into the ion trap, only around 5%, up to a maximum of 10%, are captured when the RF voltage has a sinusoidal characteristic; most of the remaining ions are lost. The solution offered in the patent specification, with an RF voltage which is very different from a sine curve, is difficult to produce and also energy-intensive. The general method of generating the RF voltage is to use an air core transformer which, in conjunction with the electrodes of the ion trap, forms a high-quality resonant circuit for the selected frequency for energy-saving, easily controllable operation without creating detrimental higher harmonic frequencies (harmonics or overtones).

If the high-quality resonant circuit RF supply is to be maintained, other principles must be found to increase the capture efficiency.

Behind the aperture in the end cap electrode through which the ions are injected, the electric field repels the ions back through the aperture in one half phase of the RF voltage. This field prevents ions entering over all but a few angular degrees in the vicinity of the zero crossing of the RF voltage. In the other half phase, an electric field easily amounting to several kilovolts per millimeter accelerates the ions injected with low kinetic energy to high speeds, propels them through the center of the ion trap, and makes them impact onto the opposite end cap electrode. This impact can be avoided if the potential on this end cap electrode is increased to a level at which the ions can no longer impact. This requires only a slight increase in the potential since the ions entered the ion trap with low initial energy anyway, to which they are again decelerated after passing through the potential minimum in the ion trap. But the ions thus reflected will then impact on the end cap electrode through which they were injected, after again flying through the center. In general, the pressure of the collision gas in the ion trap is not sufficient to produce a noticeable reduction in speed; the pressure is conventionally set so that the average mean free path is a multiple of the diameter of the ion trap. This pressure is optimal if the ion trap is also to be used as an ion mass analyzer since, in this case, no massive interferences as a result of collision deflections are to be expected during the mass-selective ion ejection. In ion traps are solely used for reactions, the collision gas pressure should be set higher, but even here a considerable damping cannot be achieved in flight lengths of one or two trap diameters in length.

Figure 2:
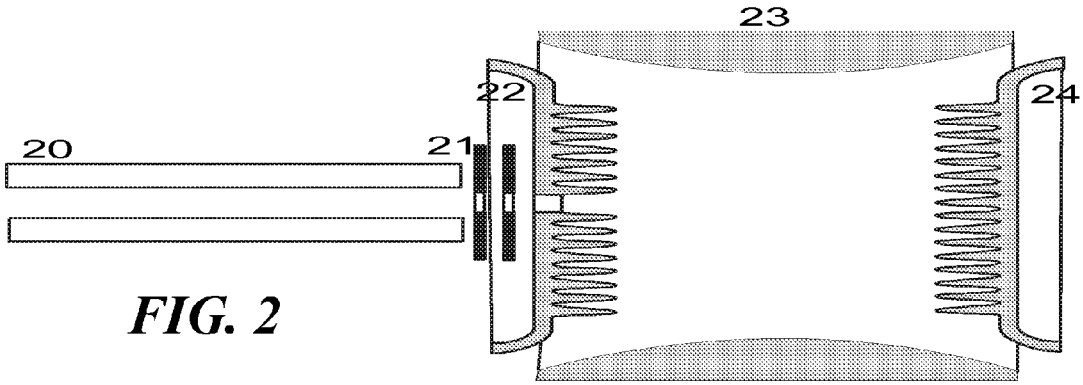
FIG. 2 represents an example of a three-dimensional RF ion trap according to the invention whose form is very different to the form previously considered ideal. The end cap electrodes (22 and 24) are profiled with protruding ridges to produce a diffuse reflection of the injected ions and hence improved capture. The ring electrode (23) can also be equipped with such ridges.

According to the invention, the capture rate for ions can now be increased if the ions are strongly scattered in diffuse directions at the opposite end cap electrode in the course of the reflection. This can be achieved by using a strongly profiled surface as shown in FIG. 2, for example. The profile can take the shape of grooves, ridges, or protrusions. Since a reflection with strong components in lateral directions has a much smaller velocity component and hence a much smaller momentum component in the reverse axial direction, the ions generally can no longer reach the end cap electrode through which they entered. Moreover, as described above, the pressure of the damping gas in the ion trap can be increased to achieve faster damping of the ion oscillations. These measures make it possible to increase the capture rate to around 50% of the ions supplied. In addition, the surface of the ring electrode can also be equipped with this type of profile in order to bring about a diffuse reflection here as well. There is now no need for the ion trap to be hyperbolic; it is possible to choose a simple cylindrical ring electrode with two flat covers as end cap electrodes, for example. The surface profile creates a near field of the pseudopotential, which allows diffuse reflection at a flat wall or a cylinder wall as well.

Since the radically reshaped ion trap is no longer well suited to resonance excitation of ions, the analyte ions should no longer be isolated in the ion trap itself. The analyte ions should therefore be suitably separated from all other ions before being introduced into the ion trap. "Isolating" the ions means that only the desired analyte ions in a mixture of ions are retained, while the other ions are separated out. This type of isolation can, for example, be undertaken in a quadrupole rod system operating as a quadrupole filter, through which the ions must pass on their way to the ion trap, such as the quadrupole rod system (20), which must then work as a quadrupole filter with a superimposed DC voltage.

The capture rate for the ions can be increased even more, however, by building an RF ion trap which can be switched to operate for part of the time as a linear ion trap with good ion capture and for part of the time as a three-dimensional ion trap, the latter for ion reactions.

Figure 3:
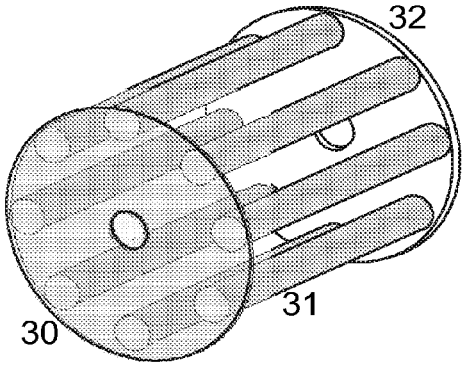
FIG. 3 illustrates schematically a completely different form of an ion trap according to the invention, comprising eight pole rods (31) and two end cap electrodes (30 and 32). By connecting the pole rods (31) in pairs with the two phases of an RF voltage, it can be operated as a linear octopole ion trap; or, alternatively, by connecting the pole rods (31) to a common RF phase, it can be operated as a three-dimensional RF ion trap. The pole rods together then form the ring electrode of the RF ion trap.
Figure 4:
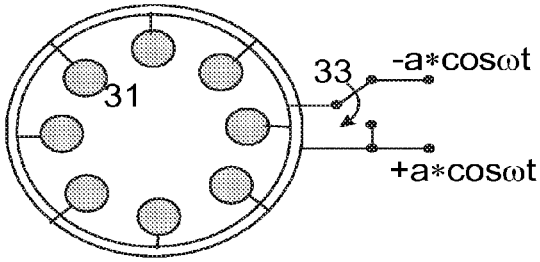
FIG. 4 also shows the octopole ion trap of FIG. 3, showing the connection scheme of the RF voltages across the octopole rods (31) with a switch (33), which switches from the paired connection with two phases to a single-phase connection.

FIG. 3 shows a first example of this type of ion trap—an ion trap whose ring electrode is divided into eight pole rods and rearranged. If the two phases of an RF voltage are connected alternately to adjacent pole rods, this creates a linear octopole ion trap with familiar good capture ability for the ions injected axially with very low kinetic energy, particularly at increased damping gas pressure. The two end cap electrodes then carry slightly repulsive DC voltage potentials to prevent the ions from flowing out. Once the analyte ions have been captured, the ion trap can be switched over to operate as a three-dimensional ion trap. This is done using only one phase of an RF voltage and connecting it to all eight pole rods together, which thus replace the ring electrode. FIG. 4 shows a schematic representation of this type of switching option.

Here, as well, it is favorable to use a quadrupole filter to isolate the analyte ions before they are introduced into the linear octopole ion trap, if the analyte ions are to be subjected to further reactions without being mixed with other types of ions.

Figure 5:
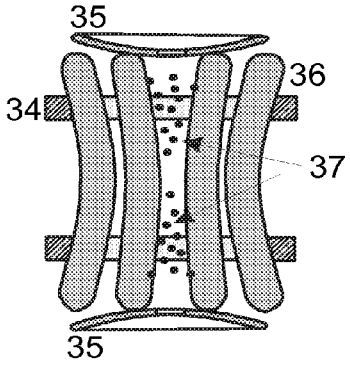
FIG. 5 illustrates a hexapole ion trap similar to the octopole ion trap in FIG. 3, but with slightly curved pole rods (36) held by two ceramic rings (34), and with two curved end cap electrodes (35). The illustration shows how the ions gather in an elongated cloud (37), almost divided into two separate regions along the axis of the system when the ion trap is operated as a linear hexapole ion trap.
Figure 6:
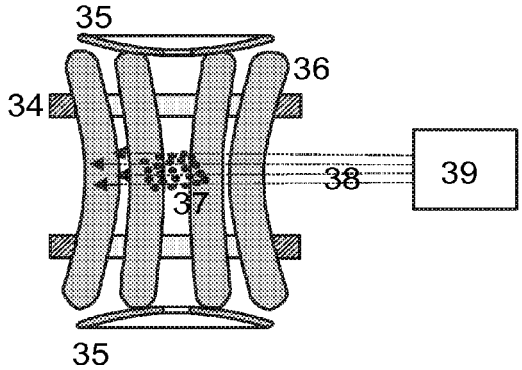
FIG. 6 illustrates the almost spherical ion cloud (37) in three-dimensional ion trap mode, which is particularly suitable for reactions with negative ions involved. In general, freshly introduced negative ions should have an equal chance to react with any positive ion in the trap, not only with the ions within the front area of an elongated cloud. —The almost spherical ion cloud (37) can also easily be irradiated from outside with a beam (38) from a generator (39); the beam can consist either of infrared photons for an IRMPD fragmentation or of highly excited helium atoms from an FAB generator for a MAID fragmentation of protein ions.

After the switchover, the analyte ions, which form greatly elongated clouds in linear ion traps—shown in FIG. 5 for a hexapole ion trap with slightly curved pole rods as an elongated cloud along the axis of the system—contract to a more spherical cloud, as can be seen in FIG. 6. This is because, according to the Laplace equation, the RF field in the interior forms a narrow rotational quadrupole potential saddle, which has the same shape in the immediate vicinity of the saddle point in all three-dimensional ion traps, and which forms a pseudopotential minimum. Unfortunately, the holding force of this pseudopotential minimum becomes weaker the longer the pole rods relative to their inner diameter. It is therefore necessary to find a compromise here between an elongated linear ion trap and a three-dimensional ion trap which is as short as possible. It is favorable if the distance between the end cap electrodes is, at most, as long as the inside diameter between the pole rods, or at least is only slightly longer. The capture in the linear ion trap must then be aided by a relatively high damping gas pressure or by profiling the end cap electrodes. The mean free path of the ions should be only a fraction of the distance between the end cap electrodes.

Figure 9:
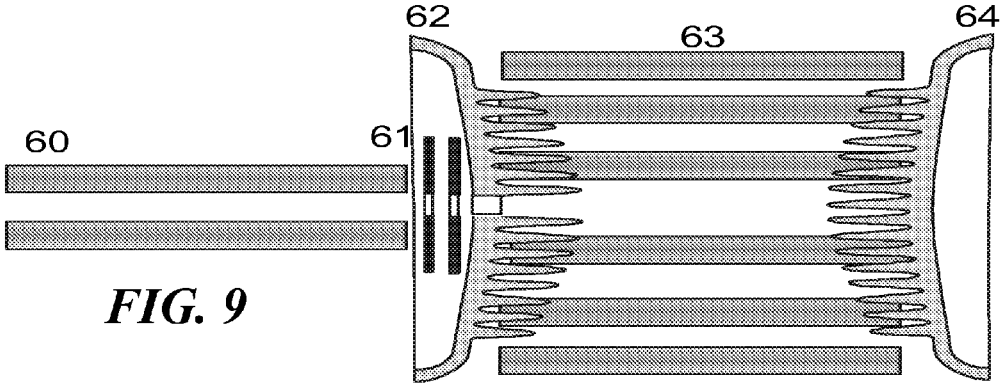
FIG. 9 shows a schematic representation of an ion trap whose ring electrode is divided into twelve pole rods (63), and whose end cap electrodes (62) and (64) are profiled with ridges to generate scattering reflections of the ions injected with low kinetic energies. When operated as a linear dodecapole rod system and the amount of stored ions is high, the ions here collect in the interior in the form of an annular cloud located in front of the pole rods (63) in a balance between Coulomb forces and dodecapole pseudopotential; when operated as a three-dimensional ion trap, the ions form a spherical cloud in the center, which is particularly suitable for reactions with captured negative reactant ions, with infrared photons or highly excited atoms.

Another embodiment is shown in FIG. 9: the linear dodecapole ion trap is relatively short and the end cap electrodes (62) and (64) are profiled with a hyperbolic envelope. The ions injected with low kinetic energy undergo scattered reflection at the profiles of the opposite end cap electrode. The value of the DC potential of this end cap electrode is selected to be high enough that the ions injected just fail to reach the electrode. The ions which undergo scattered reflection can also no longer reach the rear end cap electrode through which they were injected because after the scattering reflection their momentum component in this direction is no longer sufficient. When the system is operated as a linear dodecapole ion trap, the ions collect as a toroidal cloud in front of the pole rods (63). They are driven thereto by the DC potentials between the end cap electrodes and the pole rods and by the Coulomb forces, and hindered from hitting the pole rods by the pseudopotential in front of the pole rods. If a three-dimensional ion trap is now produced by means of a common RF voltage phase on all pole rods, the ions collect in a now spherical cloud in the center of the ion trap. It may be necessary to carry out the switching slowly in order to avoid any ion losses during the switching. It can be expedient here to first slowly remove one phase of the high voltage applied to one half of the pole rods, and then increase to a voltage with opposite phase, so that after the increase, the same phase of the RF voltage is applied to all the pole rods.

Figure 10:
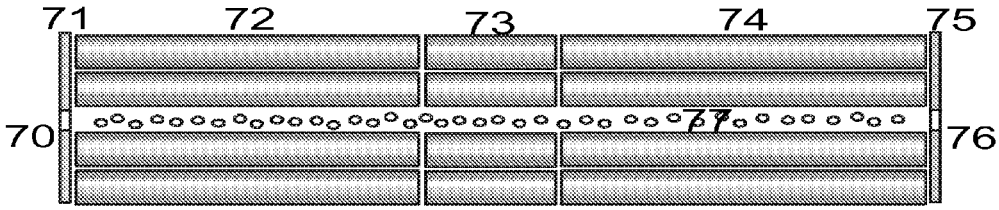
FIGS. 10, 11, and 12 present a view into an elongated octopole rod system which can be used as a two-dimensional and, in the middle part, as a three-dimensional ion trap. The pole rods are divided into three segments, two front segments (72, 74) and a short middle segment (73). In the two-dimensional mode, ions can be trapped in the usual way in this linear ion trap and form an elongated ion cloud (77), as exhibited in FIG. 10. By setting the axial DC potential in the middle segment (73) accordingly, the ions then can be collected in this middle segment (73), forming a still somewhat elongated cloud (78), as shown in FIG. 11. When the eight pole rods of the middle segment are then connected to the same phase of a RF voltage, a three-dimensional ion trap is formed in the middle segment, and the ions gather in a spherical cloud (79), as to be seen in FIG. 12. The pole rods of the outer segments may then be connected to ground, acting in the usual way as end cap electrodes. If one of the outer segments is needed to introduce reactant ions, the pole rods may keep connected to two phases of an RF voltage, forming an ion guide to transfer ions.
Figure 11:
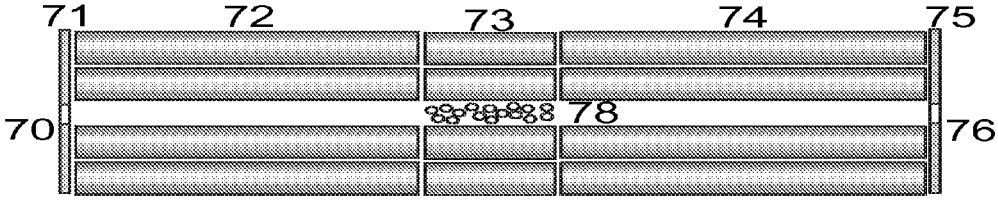
Figure 12:
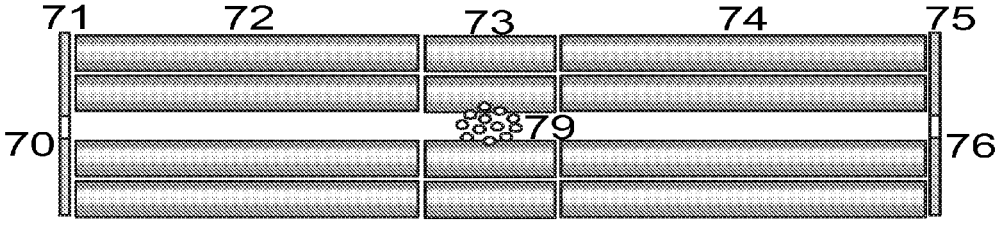

A particularly favorable embodiment is presented in FIGS. 10 to 12: An elongated octopole rod system is divided in two longer outer segments (72, 74) and one short middle segment (73). When the RF fields and the axis potentials are kept constant along all three segments, a linear ion trap is formed. In this mode, ions introduced through apertures (70 or 76) in the diaphragms (71 or 75) can be trapped in the usual way and form, after damping, an elongated ion cloud (77), to be seen in FIG. 10.

The ions in this elongated ion cloud (77) now can be collected in the middle segment (73) by adjusting the axial DC potential adequately in the middle segment. After collection and damping, the ions form a somewhat elongated cloud within this middle segment, as shown in FIG. 11.

Now the middle segment may be transformed into a three-dimensional ion trap. For this, the eight pole rods of the middle section will be connected to the same phase of the RF voltage, and the ions gather in a spherical cloud (79), as shown in FIG. 12. The pole rods of the outer sections may then be connected to a DC potential equal to the axis potential of the middle segment, making them operate as usual end cap electrodes. In this mode, the analyte ions in the spherical cloud can be easily subjected to an infrared beam for IRMPD fragmentation, or to a beam of highly excited neutrals for MAID fragmentation.

If the analyte ions within the cloud should react with reactant ions, these reactant ions can be supplied through one of the outer segments (72 or 74) by connecting the pole rods pair-wise to two phases of an ion guiding RF voltage, forming an ion guide which can transfer ions of both polarities into the three-dimensional ion trap in the middle segment. The zero voltage of the two RF phases of this ion guiding RF voltage should be identical with the DC potential within the middle section. The RF voltage for this ion guide should be much lower than the storage RF voltage for the three-dimensional ion trap, and can be different in phase and frequency.

After the analyte reacted with other ions, with photons or with excited neutrals, the product ions of the analyte ions are then ejected from the device towards a mass analyzer, using again an outer segment as an ion guide. For this, it is possible to maintain the 3D ion trap in the middle segment, or to switch back to the elongated octopole linear ion trap. The ejection can be preferably supported by a corresponding manipulation of the axis potentials in the three segments.

The length of the middle section (73) may be chosen to be relatively short. If the length of the middle section amounts to only about two third of the inner diameter between opposing pole rods, an almost ideal three-dimensional ion trap is formed. In this very favorable case, no compromise has to be sought between length of the two-dimensional and three-dimensional ion trap.

Instead of an octopole rod system, any multipole system can be used, e.g., a hexapole or dodecapole rod system. If the number of rod pairs is high, the focusing effect of the outer segments, if used as ion guides, decreases. If this cannot be accepted, it is possible to reduce the multipolarity of the ion guide by grouping two or even three neighboring pole rods and connecting the grouped pole rods to the same phase of the RF voltage. If, for instance, a dodecapole rod system is used (12 rods), a grouping of three neighboring rods each forms a quadrupolar RF field around the axis of the ion guide, with best focusing properties.

A complete method to react analyte ions in a three-dimensional ion trap may comprise the steps a) providing a multipole rod system, divided into at least three segments, b) operating the multipole rod system as a linear ion trap with a constant field distribution along the multipole rod system, c) introducing and storing analyte ions within the linear ion trap, d) supplying a single-phase RF voltage to all rods of a middle segment thus forming a three-dimensional ion trap, thereby collecting the ions in a spherical cloud within this middle segment, e) reacting the analyte ions in the three-dimensional ion trap, and f) ejecting the product ions of the reactions for mass analysis.

Between steps c) and d), the analyte ions may collected already in a middle segment by adjusting the axis potentials within the segments. For the reactions in step e), ions may be introduced into the tree-dimensional ion trap through the outer segments by making them operate as ion guides. For the ejection process of the reaction products in step f), the multipole rod system may be switched back to operate as a single elongated linear ion trap. The ejection may be supported by manipulating the axis potentials in the different segments.

In any of the embodiments described above, the analyte ions are ready for reactions with reactant ions, once they are stored in the three-dimensional ion trap. Reactant ions can now be introduced. In many cases it is not urgently necessary to have a high capture efficiency for the reactant ions since the reactant ions can generally be produced in excess, unlike the analyte ions whose analyte molecules in a sample are often available in only very limited quantities.

The reactant ions can be introduced along the same way as the analyte ions, for example, even though the capture mechanism may be completely different. The reactant ions are usually guided to the ion trap using an ion guide in the form of a multipole rod system, as can be seen in the FIGS. 2, 7, 8 and 9. Using quadrupole rod systems in the chain of ion guides, it is also possible to select one species of ion as the reactant ions by operating the quadrupole rod system as a quadrupole filter.

The process of ion capture within the three-dimensional ion trap filled with collision gas causes the reactant ions to perform wild oscillations; as a result, they slowly lose their kinetic energy by collisions with this damping gas, while flying through the cloud of analyte ions several times, before also finally ending up in the central cloud in a damped state. If they have not already reacted with the analyte ions during their transits, they do so now because they are not kept away from the ions of opposite polarity by Coulomb repulsion but, on the contrary, are attracted by them. For a reaction to happen it is necessary that the reacting ions do not have large velocities relative to each other; the presence of the collision gas means that the velocity differences are balanced out in due course, so the reactant ions definitely react with the analyte ions. When the reactions have progressed far enough, the supply of further reactant ions is stopped. This way of introducing negative reactant ions prevents a spatially localized part of positive analyte ions in the cloud from reacting to excess with the reactant ions, as is the case when two cloud strands of analyte ions and reactant ions previously kept apart are brought together in a linear ion trap.

Some of the multipole rod embodiments can easily be switched between linear ion trap mode and three-dimensional ion trap mode by means of a switch, as shown schematically in FIG. 4. Such a simple switching is problematic, however, because there is no guarantee that a high-quality resonant circuit will be generated in both switch positions. The high quality can, however, be obtained by additional tuning with capacitors, or by switching completely between two separate and individually tuned air core transformers. At the same time, a gradual switching of the RF voltages can prevent ion losses. Specialists in electrical engineering are skilled to develop such circuits which maintain the quality.

The reactions of the analyte ions generate product ions. These have to be fed to an ion analyzer in order that the product ion spectrum can be measured. The ion analyzer can operate on almost any mass spectrometric principle; principles having high ion utilization for the measurement are to be preferred, however. Ion-filtering instruments, such as magnetic sector instruments or quadrupole filter mass spectrometers, are therefore less favorable. Ion cyclotron resonance mass spectrometers (ICR-FTMS) are particularly favorable when high mass resolution and high mass accuracy are important. Very well suited are time-of-flight mass spectrometers with orthogonal injection of the ions, because they have a high dynamic range of measurement in addition to good mass accuracy and good ion utilization.

Figure 7:
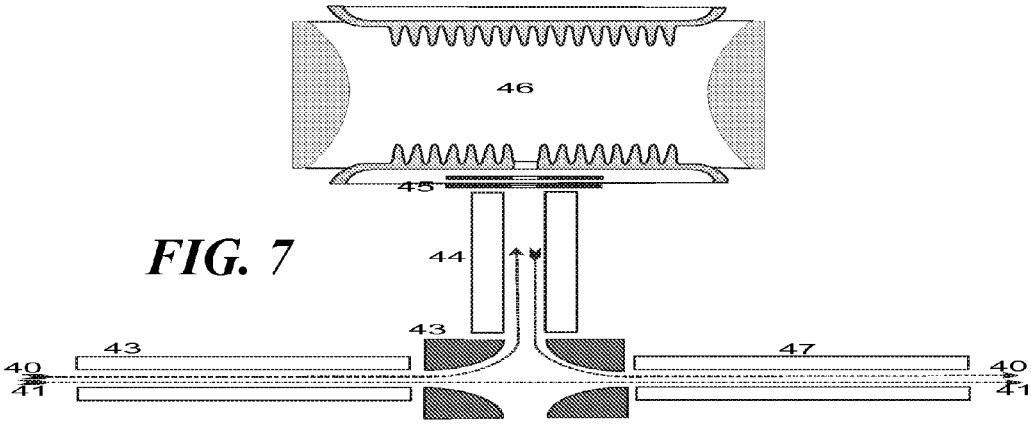
FIG. 7 illustrates the use of the three-dimensional RF ion trap in reflection arrangement, where the ions along the path (40) are deflected by the electrostatic ion switch (43) to the ion trap (45), and on the return route are transmitted on to an ion analyzer, again along the path (40). If the ions are not to be subjected to a reaction, they can be forwarded along the path (41) directly to the ion analyzer.
Figure 8:
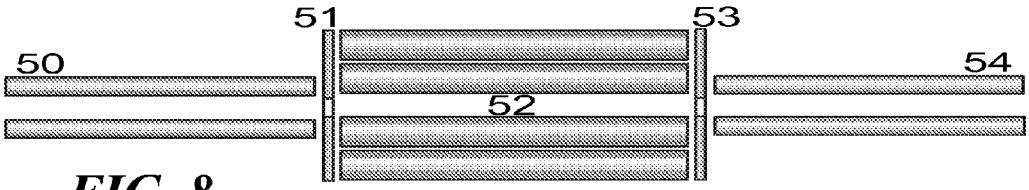
FIG. 8 illustrates the use of a three-dimensional ion trap (52), here a switchable hexapole ion trap, with direct passage from a quadrupole ion guide (50) to another quadrupole ion guide (54) which guides the ions to the ion analyzer. This arrangement can be operated either as an ion reactor or simply as an ion transit station. Switched as a quadrupole filter, the quadrupole ion guide (50) in front of the ion trap (52) can be used to isolate the analyte ions.

The product ions can be ejected from the ion trap either toward the entrance end or toward the opposite end, creating either a reflection mode of operation as in FIG. 7 or a pass-through mode of operation such as occurs in FIG. 8. Ion traps where the operation can be switched from linear ion trap to three-dimensional ion trap are particularly suitable for the pass-through mode of operation. The ejected product ions are guided to the ion mass analyzer.

The ejection of the ions can particularly be brought about by DC potentials, which are applied to the trap electrodes after the RF voltage has been switched off. In particular, these DC potentials can produce focusing effects which are very good for ejecting the product ions through one of the apertures in one of the end cap electrodes. Axial ejection into the analyzer of a time-of-flight mass spectrometer is thus possible.

The use of ion traps whose operation can be switched from linear to three-dimensional is also particularly favorable for fragmentation of the analyte ions using highly excited neutral atoms, as is described in the published patent application DE 10 2005 049 549 A1 (R. Zubarev et al.). The highly excited neutral atoms, for example highly excited helium atoms, are preferably generated in a FAB generator (39, FIG. 6) and formed into a fine beam of atoms (38). This beam of atoms must then be directed at an accumulation of analyte ions (37). This can be done particularly well in the switchable ion traps of FIGS. 3, 6 and 9 because in three-dimensional ion trap mode the analyte ions collect in the form of a small, almost spherical cloud (37), as is shown schematically in FIG. 6. The beam of atoms can then easily be directed at this cloud through the spaces between the pole rods. This electron transfer from highly excited helium atoms to the multiply positively charged analyte ions, which is also called MAID (metastable atom induced dissociation), leads to fragmentations, as also occur with electron capture (ECD=electron capture dissociation) or electron transfer from negative ions (ETD=electron transfer dissociation). The concentrated ion cloud in three-dimensional ion traps is considerably more favorable in this case than the elongated ion cloud in linear ion traps.

For a structure determination of peptides or proteins it is particularly favorable if this electron induced dissociation (ECD, ETD, MAID) can be compared to a fragmentation which was generated by a collision-induced dissociation. This is also called an "ergodic" dissociation, and is caused by a built-up excess of internal energy in the ion. The internal energy can be introduced into the ion by a large number of low-energy collisions, or also, for example, by a large number of absorbed infrared photons. In the latter case it is called IRMPD (infrared multi photon dissociation). This type of IRMPD fragmentation can also be performed well in a three-dimensional ion trap with its high concentration of analyte ions in an almost spherical cloud (37). The beam (38) in FIG. 6 can therefore also take the form of a beam of infrared photons coming from an infrared generator (39), for example from a carbon dioxide laser.

In a switchable three-dimensional ion trap, where the contours of the end cap electrodes have the shape of a hyperboloid of revolution despite the ridges or protrusions, as shown in FIG. 9, the ions can also be excited to perform resonant oscillations by an RF excitation voltage between the two end cap electrodes. It is thus possible to also perform the usual collision-induced dissociation in such an ion trap.

Furthermore, with this type of ion trap it is also possible to very quickly pulse eject the ions, which in three-dimensional operation are located in a narrow spherical cloud, out of the ion trap and into a flight path of a time-of-flight mass spectrometer. It is even possible to focus the spatially spread ions. For such an operation, it is favorable to equip an ion trap similar to the one in FIG. 9 with an exit hole in the second end cap electrode in order to operate the ion trap in pass-through mode.

The few examples given here for increasing the capture efficiency by using structured electrodes by no means cover all possibilities, however. The end cap electrodes of the conventional ion trap in FIG. 1 can also, for example, be divided into two half shells with two different reflection voltages to reflect the ions by lateral deflection in the scatter field of the two half shells. These reflecting voltages can be DC voltages as well as RF voltages. Dividing the injection electrode to achieve a lateral deflection of the ions during injection is a further way of increasing the capture efficiency. The ring electrode can also be divided into individual disk electrodes supplied with different RF amplitudes to increase the capture probability.

All these measures are only possible, however, because the RF ion trap is not used simultaneously as an ion analyzer. This limitation also makes it possible to greatly increase the collision gas pressure in the ion trap. This too serves to increase the capture efficiency, and also speeds up the damping of the ions. Additionally, this limitation allows the ion trap to be filled with a much larger number of ions for the reactions than is acceptable for functioning as an ion analyzer. For many analytical tasks, there is no real problem in not being able to use the ion trap as an ion analyzer, however, because other analyzers can be far superior to the ion trap, for example in terms of mass resolution or dynamic measurement range.

What is claimed is:

1. A three-dimensional RF ion trap comprising:

a ring electrode;

a pair of end cap electrodes positioned relative to the ring electrode to form an enclosed interior space, and;

an electric supply delivering a single-phase RF voltage to the ring electrode, wherein a surface facing the interior space of at least one of the ring electrode and end cap electrodes has a profile with edges and protrusions, thereby resulting in a diffuse reflection of ions introduced into the ion trap.

2. The three-dimensional RF ion trap according to claim 1, wherein at least one of the end cap electrodes has a surface facing the interior space with a profile including edges and protrusions.

3. The three-dimensional RF ion trap according to claim 2, wherein at least one of the end cap electrodes is divided into physically separate electrode components.

4. A three-dimensional RF ion trap comprising:

a ring electrode formed from pairs of pole rods;

a pair of end cap electrodes, and;

an electric supply delivering a single-phase RF voltage to the pole rods forming the ring electrode, wherein at least one of the end cap electrodes is formed from a plurality of physically separate electrode components.

5. The three-dimensional RF ion trap according to claim 4, wherein the ring electrode is formed from pairs of electrode components and the electronic supply is configured to switch between supplying a one-phase RF voltage to all ring electrode components and supplying a two-phase RF voltage to pairs of the ring electrode components.

6. The three-dimensional RF ion trap according to claim 4, wherein the pairs of pole rods forming the ring electrode constitute a middle segment of an elongated pole rod system.

* * * * *